United States Patent [19]

Perkins

[11] 4,231,576

[45] Nov. 4, 1980

[54] GOLF CLUB HEAD ALIGNMENT APPARATUS

[76] Inventor: Sonnie J. Perkins, 1437 180th N.E., Bellevue, Wash. 98008

[21] Appl. No.: 13,028

[22] Filed: Feb. 21, 1979

[51] Int. Cl.[3] ..... A63B 69/36

[52] U.S. Cl. ..... 273/183 D; 273/77 A

[58] Field of Search ..... 273/183 D, 183 E, 163 R, 273/163 A, 164, 77 A, 162 R; 35/29 A

[56] References Cited

U.S. PATENT DOCUMENTS

| | | | |
|---|---|---|---|
| 2,771,678 | 11/1956 | Hansen | 273/183 D |
| 3,019,022 | 1/1962 | Ehmke | 273/163 R |
| 3,876,211 | 4/1975 | Caligiuri | 273/183 D |
| 3,880,430 | 4/1975 | McCabe | 273/183 D |
| 3,951,415 | 4/1976 | Stuart | 273/183 D |
| 4,136,877 | 1/1979 | Antonious | 273/183 D X |
| 4,143,877 | 3/1979 | Jeffries | 273/183 E |

*Primary Examiner*—George J. Marlo

*Attorney, Agent, or Firm*—William W. Haefliger

[57] ABSTRACT

A golf club head incorporates:

(a) multiple indicia of different configurations on a lower portion of the head rear side, said indicia being spaced apart in two directions and presented upwardly for viewing by the player, and (b) an alignment marker on the head above the level of said indicia and adapted to be brought into visual alignment with a selected one of said indicia in response to adjustment shifting of the player relative to the club head.

5 Claims, 7 Drawing Figures

GOLF CLUB HEAD ALIGNMENT APPARATUS

BACKGROUND OF THE INVENTION

This invention relates generally to method and apparatus to accurately position a golf club relative to the golfer and to the golf ball to be struck; and more particularly it concerns a visual means to obtain repeatedly accurate positioning of different clubs in a set.

Conventional irons are designed in such manner that the nine iron shaft is shorter and has a more vertical position when addressing the ball than the 2-8 irons. The shafts become progressively longer as the "numbers" of the irons decrease in sequence; also, the lofts of the golf clubs faces become increasingly more vertical as the "numbers" of the irons decrease in sequence. In addition, the weights of irons decrease as the "numbers" decrease in sequence. Further, conventional clubs are designed to distribute head weight toward the heel and toe, and to control the center of gravity of the head, to make clubs easier to "play".

While these features are advantageous, they do not attack the problem which results from the fact that the poor golfer generally has a poor swing, which tends to repeat, nor does he have the time to practice sufficiently to develop a proper swing or stance, the latter being an essential part of the swing. Since each club is different from every other, the difficulties of developing a proper alignment position or stance, and swing are compounded.

SUMMARY OF THE INVENTION

It is a major object of the invention to provide means enabling the player to learn his particular and most accurate and effective alignment position with each club, thereby enhancing accuracy since stance and body posture employed in addressing the ball would be approximately the same for each iron.

These objectives are realized in accordance with the invention through provision of an index system characterized in that a marker on the club is visually lined up with a selected indicia or index mark on the rear side of the club head, the indicia located in such positions on the dfferent iron heads that the golfer is assured of placing his hands and body in positions required for his particular repetition of swing. Thus, he learns the proper position for his particular swing by testng with one club and varying his position until he has optimized his swing; thereafter he continues to use or visually align with the same selected index point or indicia for the various irons.

Basically, the invention is embodied in the provision of:

(a) multiple indicia on a lower portion of the head rear side, said indicia presented upwardly for viewing by the player, and (b) an alignment marker on the head above the level of said indicia and adapted to be brought into visual alignment with a selected one of said indicia in response to adjustment shifting of the club shaft forwardly or rearwardly relative to the player, or closer to or further from the player.

As will be seen, the club may comprise an iron or wood having a head with a recess sunk in the rear side to control weight thereof, the lower extend of the recess bounded by a ledge on which the indicia are located; the indicia may be spaced apart in two directions; i.e. in the direction between the toe and heel of the club and in the forward direction between the front and rear side of the head; the marker may typically overlie the recess, and be located at the upper portion of the head rear side, or the marker may be located at the rear side of the club shaft in which case the indicia are located proximate the heel of the head. Accordingly, use of the indicia and marker causes the golfer to assume a predetermined club alignment relative to his hands and body, in both forward and lateral directions. This particular causes the golfer to control the club loft precisely each and every time, for more accurate distance control.

These and other objects and advantages of the invention, as well as the details of an illustrative embodiments, will be more fully understood from the following description and drawings, in which:

DRAWING DESCRIPTION

Figure 1:
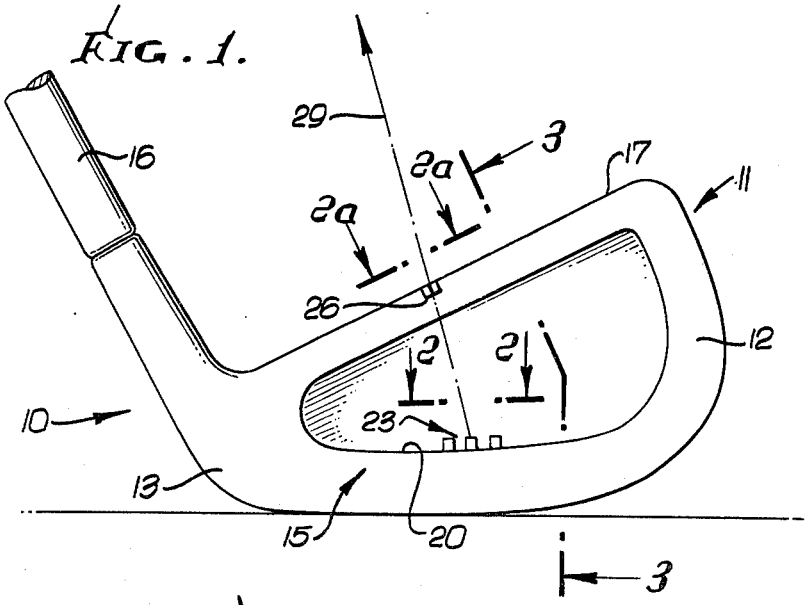
FIG. 1 is a side elevation of the rear side of an iron head.
Figure 4:
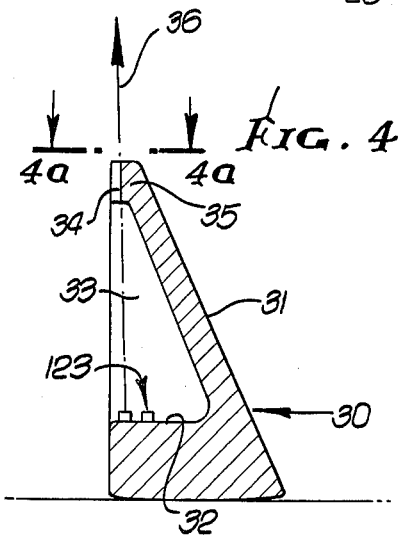
FIG. 4 is a view like FIG. 3, but showing a different iron.
Figure 4A:
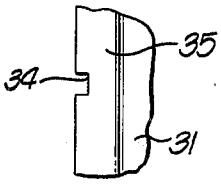
Figure 5:
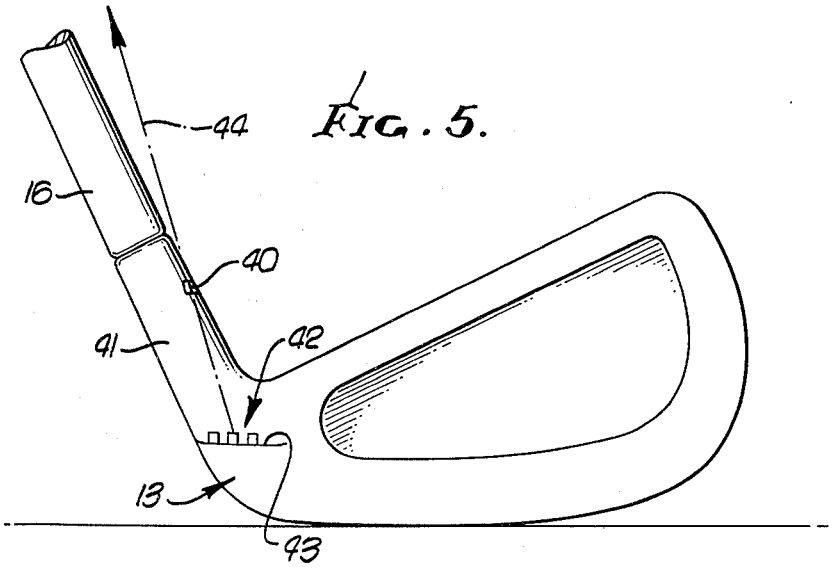

FIG. 4*a* is a fragmentary plan view on lines 4*a*—4*a* of FIG. 4; and FIG. 5 is a view like FIG. 1 but showing a modified form of the invention.

DETAILED DESCRIPTION

Figure 2:
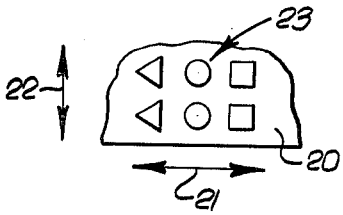
FIG. 2 is a fragmentary plan view of indicia on the FIG. 1 head, and taken on lines 2—2 of FIG. 1.
Figure 3:
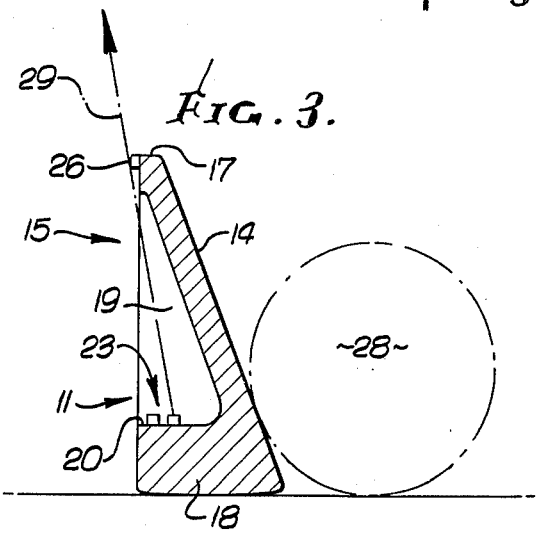
FIG. 3 is a section taken in elevation on lines 3—3 of FIG. 1.

In FIGS. 1-3 a golf club such as iron 10 has a head 11 defining a toe 12, heel 13, upright front face 14, and rear side 15. A shaft 16 is connected to the head. The head also has an upper portion 17 and a lower portion 18. Recess 19 is sunk in the head rear side toward front face 14, as shown, the lower extend of the recess being bounded by an upwardly facing ledge 20 or lower portion 18.

In accordance with the invention, multiple indicia are locted on a lower portion of the head rear side, the indicia being presented upwardly for viewing by the player. As shown in FIGS. 1, 2 and 3, the indicia 23 are located on ledge 20 and are spaced apart in two directions indicated by arrows 21 and 22 in FIG. 2; that is, arrow 21 designates the direction generally between the head toe and heel, and arrow 22 designates the direction extending generally forwardly and rearwardly relative to the head. The indicia 23 may have different forms, and merely for purposes of illustration they may have triangle, circle and square forms in direction 21, two rows of same being provided. Other shapes and orientations may be employed.

Figure 2A:
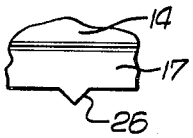
FIG. 2*a* is a fragmentary plan view of a marker, and taken on lines 2*a*—2*a* of FIG. 1.

Also in accordance with the invention, an alignment marker is provided on the head above the level of the indicia, so as to be adapted to be brought into visual alignment with a selected one of the indicia in response to adjustment tilting of the club head forwardly of rearwardly (in direction 22), or shifting of the player's stance toward or away from the ball (in direction 21). As shown in FIGS. 1, 2*a* and 3, the marker 26 overlies the recess 19, and has the form of an arrow head to be visually lined up with a selected one of the indicia 23 as the player addresses the ball 28. Note the line of sight 29. Accordingly, no matter which iron the player has, he is caused to adjust his stance and set his body and hands in such manner as to correctly address the ball for repeating his most natural and effective learned swing of the club.

FIG. 4 shows an iron head 30 having a front face 31 with greater tilt from vertical than front face 14 in FIG. 3. Here again, the indicia 123 (like indicia 23) are located on a ledge 32 bounding the lower extent of recess 33 in the head rear side. The marker 34 located on the head upper portion 35 is in the form of a slot in the rear side of that upper portion. Note line of sight 36 passing through the slot and intersecting a selected one of the indicia.

In FIG. 5, the outwardly protruding marker 40 is located on the rear side of the club shaft, above the hosel 41. The indicia 42, like indicia 23, are located on a ledge 43 located on the rear side of the head, but at the heal region 13. Note line of sight 44.

I claim:

1. In combination with a golf club having a head defining a toe, heel, upright front face and rear side, the improvement combination comprising (a) multiple indicia on a lower portion of the head rear side, said indicia presented upwardly for viewing by the player, and (b) an alignment marker on the club above the level of said indicia and adapted to be brought into visual alignment with a selected one of said indicia in response to adjustment shifting of the player relative to the club head, (c) the indicia on said lower portion of the head rear side being discrete and separate from one another, and also spaced apart both in a first direction extending generally between the toe and heel, and also in a second and forward direction extending generally toward the front face, different of said indicia having at least two different configurations.

2. The improvement combination of claim 1 wherein said club comprises an iron with said head having a recess sunk therein from said rear side toward said front face, the lower extent of the recess bounded by an upwardly facing ledge defined by the head, said indicia located on said ledge.

3. The improvement combination of claim 1 wherein said marker overlies said lower portion and is located on an upper portion of the head rear side.

4. The improvement combination of claim 1 wherein the marker is located on the club shaft at the rear side thereof.

5. The improvement combination of claim 1 wherein the indicia are located proximate the heel of the head.

* * * * *